United States Patent [19]

Bailey

[11] 4,225,135

[45] Sep. 30, 1980

[54] KICKER-TYPE BUMPER ASSEMBLY FOR GAMES

[75] Inventor: Dennis Bailey, Greenwood, Ark.

[73] Assignee: Spang Industries, Inc., Butler, Pa.

[21] Appl. No.: 951,316

[22] Filed: Oct. 13, 1978

[51] Int. Cl.[3] ..... A63B 71/00

[52] U.S. Cl. ..... 273/129 P; 273/121 A

[58] Field of Search ..... 273/118 A, 123 A, 127 R, 273/129 R, 129 E, 125 A, 121 A, 122 A, 124 A, 125 A, 119 A, 120 A, 127 C, 129 P, 129 S; 206/61.11, 61.1

[56] References Cited

U.S. PATENT DOCUMENTS

| | | | |
|---|---|---|---|
| 2,182,418 | 12/1939 | Williams | 273/121 A |
| 2,184,866 | 12/1939 | Radtke | 273/121 A |
| 2,191,209 | 2/1940 | Hooker | 273/121 A |
| 2,501,021 | 3/1950 | Benak | 273/129 R |
| 2,547,164 | 4/1951 | Lemek | 273/121 A |
| 4,109,916 | 8/1978 | Breslow | 273/121 A |

FOREIGN PATENT DOCUMENTS

| | | | |
|---|---|---|---|
| 1382662 | 11/1964 | France | 273/119 A |

*Primary Examiner*—Richard C. Pinkham
*Assistant Examiner*—T. Brown
*Attorney, Agent, or Firm*—Reed, Smith, Shaw & McClay

[57] ABSTRACT

A bumper assembly for use in pin-ball games. The bumper assembly includes a plurality of bumpers that are connected by shafts to a kicker arm which is fixed to the core of the solenoid such that the plurality of bumpers are controlled together by the solenoid and only a single solenoid is required for all the bumpers. The playing surface and bumper are electrically conductive and are electrically connected to the solenoid. The ball played with the game is electrically conductive and will complete the electrical circuit between the bumper and playing surface to cause energization of the solenoid which will cause the bumper to move downwards and further cause the ball to be projected away from the bumper.

9 Claims, 2 Drawing Figures

KICKER-TYPE BUMPER ASSEMBLY FOR GAMES

BACKGROUND OF THE INVENTION

1. Field of the Invention

The present invention relates to games and, more specifically, to pinball games.

2. Description of the Prior Art

In the prior art, many games have been proposed in which a ball is made to traverse a playing surface for a variety of objects, depending on the design of the particular game. U.S. Pat. Nos. 3,975,019; 4,039,191; 2,219,898; and 2,212,097 are considered to be generally illustrative of such games. Probably, the most widely accepted of games of this nature are known as pin-ball games, sometimes also referred to as bumper pool games. U.S. Pat. Nos. 2,501,021; and 2,727,743 are considered to be illustrative.

These pinball games have generally included a bumper of some kind which diverts the direction of a ball that encounters the bumper. Many times, the bumpers are kicker-type bumpers in which the ball triggers a sensing mechanism that activates the bumper such that it impacts the ball with sufficient force to accelerate it away from the bumper. These kicker-type bumpers are generally complex devices which have posed persistant problems with respect to reliability and expense. Kicker-type bumpers have now been perfected to the point where they have achieved acceptable reliability. However, due to their complexity, the cost of these kicker-type bumpers has remained relatively high so that their use is almost exclusively restricted to pinball games intended for commercial use. U.S. Pat. Nos. 2,322,091; 2,487,979; 3,857,567; 3,826,883; 3,785,653; 3,180,646; and 2,328,667 are considered to be generally illustrative of kicker-type bumpers intended for commercial use.

There has, however, also existed a market for entertainment games such as pinball games which are suitable for private use. Accordingly, there existed need in prior art games, and particularly pinball games, for a kicker-type bumper which was reliable but yet inexpensive enough to permit its use in non-commercial applications, such as games designed for home enjoyment.

SUMMARY OF THE INVENTION

The presently disclosed invention is a kicker-type bumper assembly for use in games in which an electrically conductive ball traverses the playing surface of a game board having a base layer, a contact plate, and an insulation layer that electrically isolates the base layer from the contact plate layer. The bumper assembly includes a solenoid, a bumper support member that is responsive to the longitudinal movement of the solenoid core, a bumper fastened to one end of the bumper support member, and a spring concentrically disposed about a portion of the bumper support member. The spring, which extends through aperatures in the insulation layer and one of the base layers or the contact plate layer of the game board, is electrically connected to the other of the base layer or contact plate such that when the ball makes electrical contact between this other layer and the spring, an electrical circuit is completed between the base layer and the contact plate that energizes the solenoid to actuate the kickertype bumper assembly.

Preferably, the bumper assembly includes a single solenoid which simultaneously actuates a plurality of bumpers. Also preferably, the spring member passes through an aperature in the base layer and is electrically connected to the contact plate such that the ball makes electrical contact between the spring and the base layer to complete the electrical circuit between the contact plate and the base layer that energizes the solenoid.

In accordance with the present invention, a kicker-type bumper assembly is provided which is reliable but economical so that it is suitable for use in pin-ball games and similar games which are intended for private use. Other details, objects and advantages of the present invention will become apparent as the following description of the presently preferred embodiment of the same proceeds.

BRIEF DESCRIPTION OF THE DRAWINGS

In the accompanying drawings, the presently preferred embodiments of the invention are shown in which.

PREFERRED EMBODIMENT OF THE PRESENT INVENTION

Figure 1:
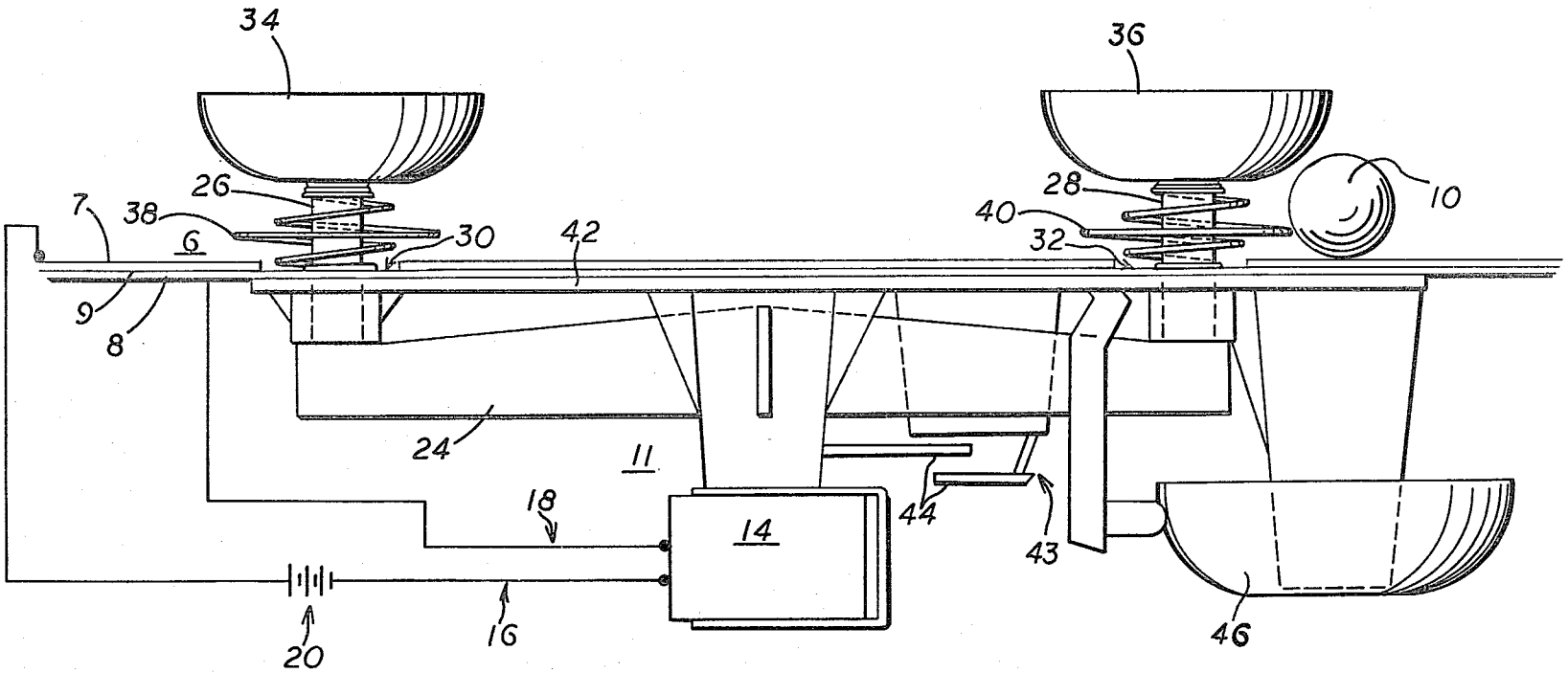
FIG. 1 is an elevational cross-section of a pinball game that, includes the presently preferred embodiment of the kickertype bumper assembly.

FIG. 1 shows an elevation of a pin-ball game incorporating the presently disclosed kicker-type bumper assembly. The pin-ball game includes a game board 6 comprised of a base layer 7, a contact plate layer 8, and an insulation layer 9 that electrically isolates base layer 7 from contact plate layer 8. In the operation of the pin-ball game, an electrically conductive ball 10 is caused to traverse the exposed surface of base layer 7 so as to score points or achieve other results in accordance with the object of the game through the execution of various maneuvers of ball 10.

Figure 2:
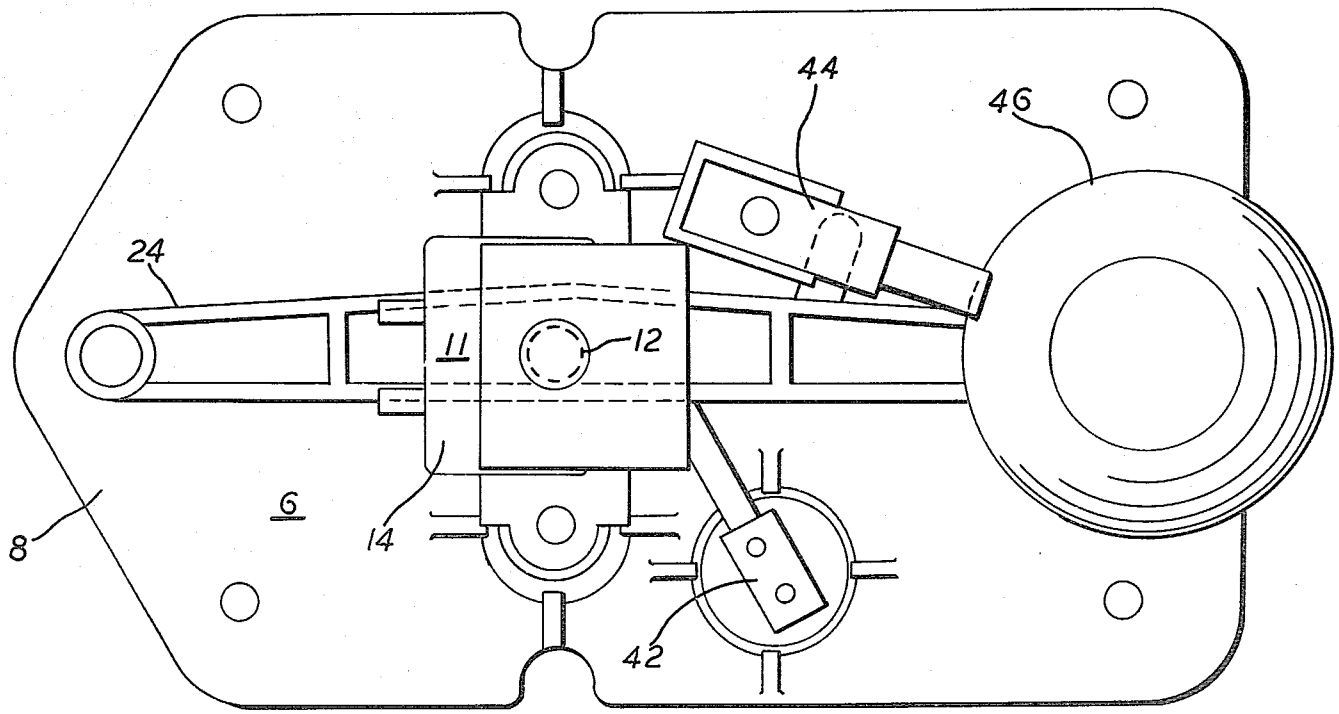
FIG. 2 is a bottom view of the bumper assembly of FIG. 1.

Of these maneuvers, one of prominence in most pin ball games is to cause the ball to strike a bumper. Typically, the bumper is a kicker-type bumper which is activated to strike the ball and accelerate it radially away from the bumper. FIGS. 1 and 2 show the bumper assembly of the presently preferred embodiment which includes a solenoid 11 having a core member 12 and a coil 14 concentrically arranged about core member 12. When energized through terminals 16 and 18, coil 14 urges longitudinal movement of core 12 toward the center of coil 14. Terminal 16 of solenoid coil 14 is electrically connected through a power source 20 to base layer 7 and terminal 18 is connected to contact plate 8. A bumper support member 24 is fastened to core 12 and is responsive to the longitudinal movement thereof. Bumper support member 24 includes extremities or arms 26 and 28 which extend through respective aperatures 30 and 32 in game board 6 and protrude at least partially above the upper surface of game board 6. Bumpers 34 and 36 are fastened on the protruding ends of arms 26 and 28 respectively. Concentrically arranged about arms 26 and 28 are springs 38 and 40 which extend at least partially through aperatures 30 and 32 in base layer 7 and insulation layer 9 and are electrically connected to contact plate layer 8. Preferably, springs 38 and 40 are electrically connected to contact plate 8 through a flange member 42 which also serves to guide the longitudinal movement of arms 26 and 28 within aperatures 30 and 32.

In accordance with the operation of the preferred embodiment, the kicker-type bumper is initially in a position as illustrated in FIGS. 1 and 2 in which springs 38 and 40 urge bumpers 34 and 36 into their extreme position away from game board 6 such that bumper support member 24 is in a first position in which it is abutted against flange member 42 and core member 12 is partially withdrawn from coil 14. When electrically conductive ball 10 rolls across the exposed surface of base layer 7 and contacts spring 38 or 40, an electrical current path is completed from base layer 7 to contact plate layer 8 through conductive ball 10 and spring 38 or 40.

Completion of the current path between base layer 7 and contact plate layer 8 completes an electrical circuit between opposite terminals of power source 20 through solenoid coil 14 thus energizing coil 14 causing it urge core member 12 longitudinally downward. As core member 12 moves downward, bumper support member 24 also moves downwardly whereby arms 26 and 28 are drawn longitudinally through aperatures 30 and 32 so that bumpers 34 and 36 close toward the exposed surface of game board 6. As bumpers 34 and 36 close toward game board 6, bumper support member reaches a second position at which one of the bumpers strikes ball 10, forcing it radially away from the respective bumper. As ball 10 is forced away from bumper 34 or 36, the electrical circuit between the terminals of power source 20 through solenoid coil 14 is opened such that solenoid coil 14 becomes de-energized.

Upon de-energization of solenoid coil 14, springs 38 and 40 return the kicker-type bumper assembly to the initial or first position such that the foregoing operation of the preferred embodiment will be repeated upon subsequent contact of conductive ball 10 with springs 38 or 40.

Preferably, the embodiment includes a switch 43 that controls the energization of a scoring mechanism in accordance with the operation of the kicker-type bumper assembly. The scoring mechanism includes a power source (not shown) that controllably energizes a scoring device through switch 43. The contacts 44 of switch 43 are disposed such that they are open at times when solenoid coil 14 is de-energized and bumpers 34 and 36 are at their extreme positions from game board 6. At times when solenoid coil 14 is energized such that bumpers 34 and 36 are at their closest limit of travel to game board 6, contacts 44 are closed. Accordingly, when bumpers 34 and 36 are in their initial position, the scoring device is not energized. However, when ball 10 strikes spring 38 and 40 causing bumpers 34 and 36 to be retracted, contacts 42 are closed and the scoring device is activated.

Also preferably, the present embodiment includes a bell striker 44 that is responsive to the motion of bumper support member 24. When solenoid coil 14 is energized and bumper support member 24 is drawn into the second position, bell striker 44 is caused to move radially away from bell 46 and then allowed to quickly snap back toward its original position. The inertia of bell striker 44 however, causes it to swing beyond its original position and strike bell 46. Preferably, the flexible connection of bell striker 44 to flange member 42 is sufficiently damped that the overresponse of bell striker 44 does not cause it to strike bell 46 more than once during each movement cycle of bumper support member 24.

In accordance with the description of the preferred embodiment, a kicker-type bumper assembly has been described that is both reliable and inexpensive enough for non-commercial application. The mechanical simplicity of the mechanism for completing the circuit that activates the disclosed kicker-type bumper assembly affords both economy and reliability. The disclosed embodiment affords substantial additional economy by controlling a plurality of bumpers with a single solenoid.

While a present preferred embodiment of the invention has been described, it is to be understood that the scope of the invention is not limited thereto but can be otherwise variously embodied within the scope of the following claims.

I claim:

1. A bumper assembly for use in a game in which an electrically conductive ball traverses the playing surface of a game board having a base layer, a contact plate, and an insulation layer that electrically isolates tha base layer from the contact plate layer, said bumper assembly comprising:

a solenoid having a core member and a concentrically arranged coil, said coil being electrically connected to the contact plate and the base layer and urging longitudinal movement of the core when energized;

a bumper support member that is responsive to the longitudinal movement of the core;

a bumper fastened to one end of the bumper support member; and a spring concentrically disposed about a portion of said bumper support member, said spring extending through an aperture in said insulation layer and said base layer and electrically connected to the contact plate layer such that when the ball makes electrical contact between the spring and the base layer, the ball completes a current path between said base layer and said contact plate to energize the solenoid coil and cause movement of said bumper relative to said game board, said bumper being of such shape and position relative to said playing surface that it will engage said ball to cause its projection away from said bumper during said bumper movement.

2. The bumper assembly of claim 1, said bumper assembly further comprising:

a flange member connected to the game board, said flange member having an aperature for receiving a portion of the bumper support member such that the movement of the bumper support member is guided within the aperature.

3. A bumper assembly for use in a game in which an electrically conductive ball traverses the playing surface of a game board having a base portion and a contact plate portion separated by an insulation layer that electrically isolates said base portion from said contact plate portion, said assembly comprising:

a solenoid having an electrical coil connected to the base portion and the contact plate portion, said coil urging longitudinal movement of a core when energized;

a bumper support member having a plurality of extremities extending through respective aperatures of the playing surface, said member being responsive to the movement of the core;

a plurality of bumpers, said bumpers being individually fastened to an extremity of the bumper support member; and a plurality of spring members, each of said spring members associated with one of said bumpers and being concentrically arranged about one of the extremities of said bumper support member and extending through the respective aperature in said playing surface, said spring member being electrically connected to said contact plate such that when the ball contacts said spring member, the ball closes an electrical circuit between said base and said contact plate to energize said solenoid and cause movement of the plurality of bumpers relative to the game board, said bumper being of such shape and position relative to said playing surface that it will engage said ball to cause its projection away from said bumper during said bumper movement.

4. The bumper assembly of claim 3 wherein said game further includes a scoring mechanism, said bumper assembly further comprising:

a switch that controls the energization of the scoring mechanism in response to the action of the bumper assembly.

5. The bumper assembly of claim 4 wherein one contact of said switch is connected to the bumper support member of said bumper assembly.

6. The bumper assembly of claim 3 and further comprising:

a bell that is connected to the flange member of the bumper assembly; and a bell striker that is responsive to the movement of the bumper support member, and that is disposed with respect to said bell such that the bell striker strikes the bell at least once as the bumper support member is moved from an initial position to a retracted position and returned to the initial position.

7. The bumper assembly of claim 3 said bumper assembly further comprising:

a flange member connected to the game board, said flange member having a plurality of aperatures for receiving respective extremities of the bumper support member such that the lateral movement of the bumper support member is guided by the flange member.

8. A bumper assembly for use in a game in which an electrically conductive ball traverses a playing surface, said assembly comprising:

a game board having a base layer and a contact plate layer that are separated by an insulation layer which electrically isolates said base layer from said contact plate layer;

a solenoid located on one side of said game board and electrically connected to the base layer and the contact plate layer;

a bumper support member having a plurality of arms, said bumper support member being connected to said solenoid and each of said arms extending through a respective aperature in said game board, such that the plurality of arms extend at least partially on the side of said game board opposite from said solenoid;

a plurality of bumpers, each of said bumpers being fastened to a respective arm of the bumper support member; and a plurality of spring members, each of said spring members being concentrically arranged about a respective one of the bumper support arms, each spring member being electrically connected to said contact plate layer such that when the ball contacts the spring member while traversing the base layer of the game board, an electrical current path is closed between said contact plate layer and said base layer to energize the solenoid and cause movement of said bumper relative to said game board, said bumper being of such shape and position relative to said playing surface that it will engage said ball to cause its projection away from said bumper during said bumper movement.

9. The bumper assembly of claim 8, said bumper assembly further comprising:

a flange member connected to the game board, said flange member having a plurality of aperatures for receiving respective arms of the bumper support member such that the movement of said arms through the aperatures of the game board is laterally guided by the flange member.

* * * * *